US008579532B2

(12) United States Patent
Ahrens et al.

(10) Patent No.: US 8,579,532 B2
(45) Date of Patent: Nov. 12, 2013

(54) DOSING DEVICE COMPRISING A MONOLITHIC, RESILIENT ROLL

(75) Inventors: Elvira Ahrens, Wernigerode (DE); Hans-Joachim Ahrens, Wernigerode (DE); Stephan Ahrens, München (DE)

(73) Assignee: Henkel AG & Co. KGaA, Duesseldorf (DE)

( * ) Notice: Subject to any disclaimer, the term of this patent is extended or adjusted under 35 U.S.C. 154(b) by 839 days.

(21) Appl. No.: 12/375,694

(22) PCT Filed: Apr. 20, 2007

(86) PCT No.: PCT/EP2007/003462

§ 371 (c)(1), (2), (4) Date: Jan. 30, 2009

(87) PCT Pub. No.: WO2008/014832

PCT Pub. Date: Feb. 7, 2008

(65) Prior Publication Data

US 2009/0317173 A1 Dec. 24, 2009

(30) Foreign Application Priority Data

Aug. 2, 2006 (DE) ..... 10 2006 036 401

(51) Int. Cl.
*B43M 11/02* (2006.01)

(52) U.S. Cl.
USPC ..... 401/219; 401/218

(58) Field of Classification Search
USPC ..... 401/208, 209, 218, 219, 220, 214, 216, 401/215, 197; 152/69; 222/345, 368, 494; 68/96, 97
See application file for complete search history.

(56) References Cited

U.S. PATENT DOCUMENTS

| | | | | |
|---|---|---|---|---|
| 3,235,900 | A * | 2/1966 | Klassen | 401/175 |
| 5,435,245 | A * | 7/1995 | Salisbury et al. | 101/328 |
| 6,213,665 | B1 * | 4/2001 | Degoix et al. | 401/209 |
| 6,682,244 | B2 * | 1/2004 | Gueret | 401/208 |
| 7,396,179 | B2 * | 7/2008 | Lange et al. | 401/218 |
| 2004/0069385 | A1 * | 4/2004 | Timoney et al. | 152/69 |

FOREIGN PATENT DOCUMENTS

| | | | |
|---|---|---|---|
| DE | 102005031696 | A1 | 1/2007 |
| EP | 0172592 | A1 | 2/1986 |
| EP | 0575714 | A1 | 12/1993 |
| EP | 0559771 | B1 | 1/1996 |
| EP | 1529871 | A1 | 5/2005 |
| EP | 1529871 | A1 * | 5/2005 |
| WO | WO-00/63482 | A1 | 10/2000 |
| WO | WO-2004/018760 | A1 | 3/2004 |

* cited by examiner

*Primary Examiner* — Gregory Huson
*Assistant Examiner* — Jennifer C Chiang
(74) *Attorney, Agent, or Firm* — Krista A. Kostiew

(57) ABSTRACT

A dosing device with a monolithic, resilient roll meters liquid detergent, softener, concentrates, cleaning agents, and other medium-viscosity liquids. The rolling application element is used for applying detergent to very dirty fabric areas. The monolithic roll (3) encompassing a shaft (5) and an outer jacket (6) with plastic recesses is inserted into a mount (1) of a dosing receptacle (2). Radially extending spring lamellae are molded between the shaft (5) and the outer jacket (6).

12 Claims, 7 Drawing Sheets

26
1,15
A-A

A
A

C
C 26
15
17
3
D

C-C
B
3
13
6, 7, 10
4
5
5, 11, 28
21
33
2
17
1
26
13
27
2
1
17
5, 11, 28
6, 7
34
A
33
4

DOSING DEVICE COMPRISING A MONOLITHIC, RESILIENT ROLL

CROSS-REFERENCE TO RELATED APPLICATIONS

This application is a national stage application (under 35 U.S.C. §371) of PCT/EP2007/003462, filed Apr. 20, 2007, which claims benefit of German Application 102006036401.5, filed Aug. 2, 2006.

FIELD OF THE INVENTION

The present invention relates to a dosing device having a monolithic resilient roll as a rolling applicator element for dosing liquid detergent, softener, concentrates, cleaners, adhesives, paints and other medium-viscosity liquids, whereby the rolling applicator element is provided for applying detergent to heavily soiled areas of textile, among other things.

BACKGROUND OF THE INVENTION

Previous applicator elements according to EP 0172592 for liquid detergents are known in the form of a ball, which is pressed into the holder from the interior space by a spring made of plastic. The application and thus the flow of detergent here depend on the intensity of the pressure on the textile, which is known to be very uneven. Dispensing is thus very irregular, usually occurring in a surge. Other approaches propose foam parts or brushes, but handling is complex because the supply of liquid is discontinuous.

EP 0559771 describes a very complex device for pretreating and washing textiles. An applicator element in the form of a paint brush or a foam cylinder is removable from the device for applying detergent to heavily soiled areas. However, during application, one's fingers would come in contact with detergent residues on the mount of the applicator element.

WO 2004/018760 claims only a rolling ball having recesses in an opening with lips. Approaches having a rolling roll are also known according to EP 0575714 A1, but these do not solve the problem of a perfect seal of the bearing with smooth running of the roll at the same time.

SUMMARY OF THE INVENTION

An object of the invention is to create a container for uniform application of liquid, in particular liquid detergent with a roll, largely independently of the pressure on the textile. The bearing should be perfectly sealed here.

A roll or a ball having a shaft and an outer sleeve having recesses made of a plastic is inserted into a holder of a dosing container, a plurality of spring lamellae running radially between the shaft and the outer sleeve in one piece.

The spring lamellae are configured so that they produce a spring action between the shaft and the outer sleeve in the radial direction. The spring lamellae in particular are configured so that the outer sleeve of the roll is pressed from the inside against the lips of the holder with the help of the spring pressure of the spring lamellae.

The spring lamellae may have any conceivable shape, which produces a spring action in the radial direction between the shaft and the outer sleeve. Wavy, lamellar tongue shapes are preferred. The tongues have a thickness of less than 1 mm, preferably less than 0.5 mm, especially preferably less than 0.25 mm, most especially preferably less than 0.1 mm.

The shaft, outer sleeve and spring lamellae are molded in one piece, preferably of a plastic such as a polyolefin, e.g. PE or PP. However, a smooth-rolling PA or POM is also possible.

The shaft with its journals is arranged to be easily rotatable in one bearing each. The outer sleeve made of a plastic is pressed sealingly from the inside against the lips of the holder with the help of the spring pressure of the spring lamellae. The fact that the outer sleeve is, if necessary, pressed less firmly against the lips under pressure from the outside is irrelevant for the discharge of the liquid. To this end, the radius of the outer sleeve is selected to be slightly larger than the inside radius of the bearing up to the lips.

The axis of the bearing and the axis of the shaft are shifted slightly in the direction of the outer opening with respect to the midpoint of the holder.

Additives of lubricants in the plastic, e.g. molybdenum disulfide or silicones significantly reduce the friction. The two parts may be joined by a relatively thin inner bridge and manufactured in one piece. The outer sleeve should have several axial passages or slots.

To perfectly seal the bearing despite the recesses, the arc length of the bearing in the holder should be greater than the distance from one recess to the neighboring recess. It is irrelevant here whether the recess is created radially or axially or whether there are only single recesses. In any case, the rolling applicator element in conjunction with the recesses operates like a gearwheel pump, which conveys the detergent or adhesive or paints from the interior space toward the outside. In the case of processing of adhesives or paints, a closed pin of PP or PE would be used as the container.

To ensure the highest possible imperviousness, it is also advantageous for the radius of the outer sleeve to be selected to be slightly larger than the inside radius of the bearing up to the lips.

The intrinsic elasticity of the roll due to the spring lamellae makes it possible for the outer sleeve of the spring-mounted shaft and its bearing to be installed somewhat closer to the opening of the holder in order to press the roll against the lips with a spring action to thereby achieve an optimal seal.

The roll dosing device may be configured so that when a pressure is applied to the roll, e.g. in rolling the dosing device over a textile, the outer sleeve springs away from the lips, resulting in an increase in the liquid dispensed from the dosing device.

To be sure that the liquid to be dosed cannot run along the radial spring lamellae and thus possibly enter the environment in an uncontrolled manner, it is advantageous that the inner opening in the container has a width smaller than the width of the outer sleeve of the roll. Since the grooves do not protrude all the way to the end faces of the roll, the rounded rings of the outer sleeve form a seal resiliently against the holder.

The container should comprise if possible an injection-molded upper part and a bottom part which are snapped together with the help of an upper and a lower sleeve segment in the interior space, which facilitates the cleaning of the dosing device. A bonding by ultrasound or adhesion is also advantageous. A blow-molded container is also provided, then the holder should be made of a separate, more precise injection-molded insert. A tongue with a constriction as a tamper-proof safety device is shaped in the filling opening of the container. This makes it possible to counteract unauthorized detaching the dosing device from the bottles. The holder having the rolling applicator element may be arranged on a spherical or elliptical container which is mountable on the screw cap of a bottle.

In a second fundamentally different embodiment, the holder may also be integrally molded directly on a screw cap. This screw cap is usually screwed as a closure onto a bottle containing liquid detergent.

A safety cap is usually attached via the rolling applicator element, which is arranged on a screw cap of a bottle in a holder. The screw cap may also be designed as a standing cap protruding laterally beyond the screw cap. For sealing and as a shipping lock on the protective cap, at least one sealing ring should be molded on it, engaging sealingly on the screw cap or in its ring groove. The safety cap is usually attached with an inside thread to an outside thread of the screw cap. In an important embodiment, the rolling applicator element should be a roll having recesses and/or coaxial grooves. It is also possible for the rolling applicator element to be manufactured as a ball having recesses or as a ellipsoid having recesses. A journal which reduces the rolling resistance should again be mounted on each side laterally.

For assembly, the rolling applicator element is snapped from the outer opening into the holder against a bearing that is open toward the inside.

The inventive dosing roll may also be fixedly connected to the opening of a container containing product, so that the contents of the container can be applied directly through the roll, e.g. for pretreatment of a soiled textile item. To do so, bottles, tubes, vials, flacons or the like may be provided as the container.

DESCRIPTION OF THE DRAWINGS

Other embodiments and illustrations of the present invention can be derived from the following examples and figures, in which.

DESCRIPTION OF THE PREFERRED EMBODIMENTS

Figure 1:
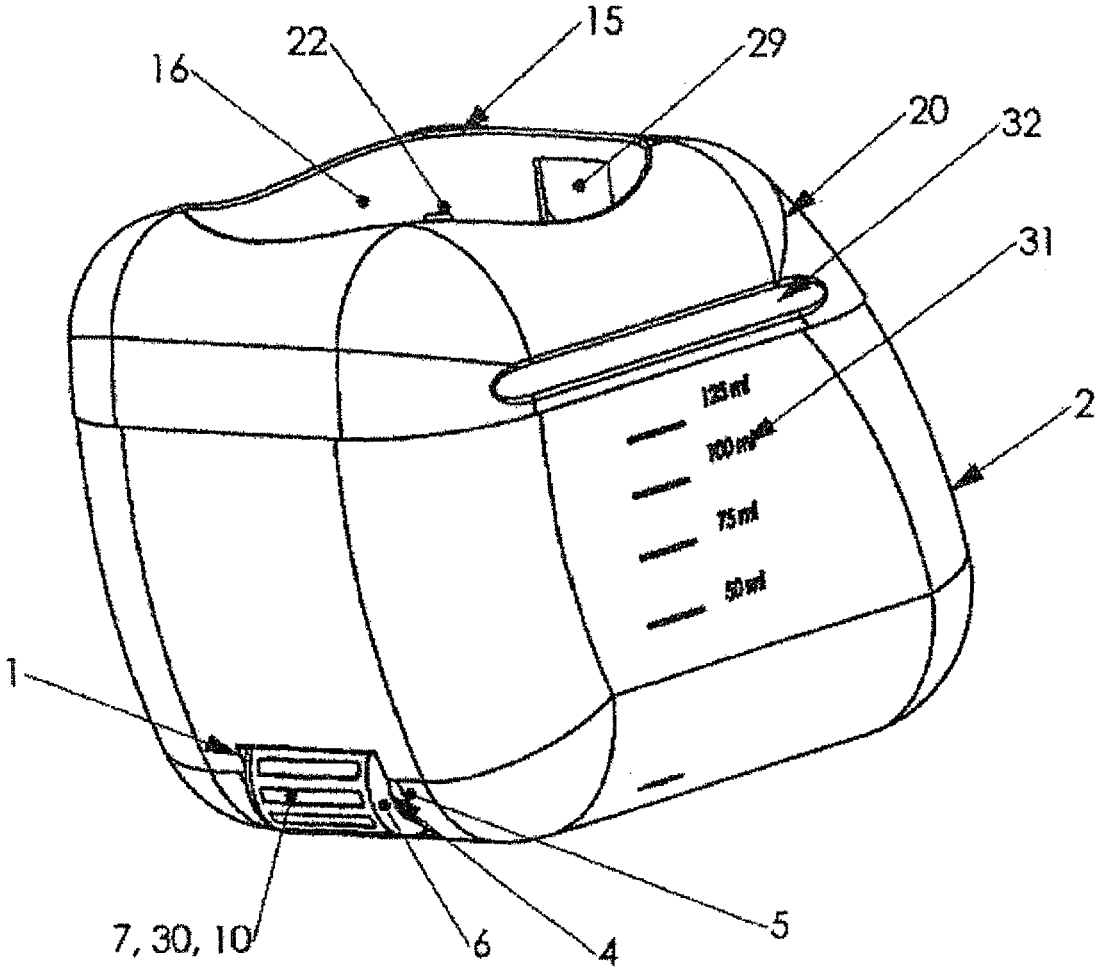
FIG. 1 shows a perspective view of a container having a roll.

FIG. 1 shows a perspective view of a container 2 at whose lower end face a holder 1 is introduced. A monolithic roll 3 comprising an outer sleeve, a plurality of spring lamellae running radially and a shaft 5 at the center is snapped into this holder 1. The outer sleeve 6 has 14 recesses 7 in the form of axial grooves 10. A collar 16 having a pouring groove 29 and a tamper-proof safety device 22 is shaped into the filling opening 15. The tamper-proof safety device is clamped beneath the screw cap 17 of the bottle 26. This counteracts theft in large markets. The markings 31 for the filling level and a grip element 32 are provided on the side of the container 2.

Figure 2:
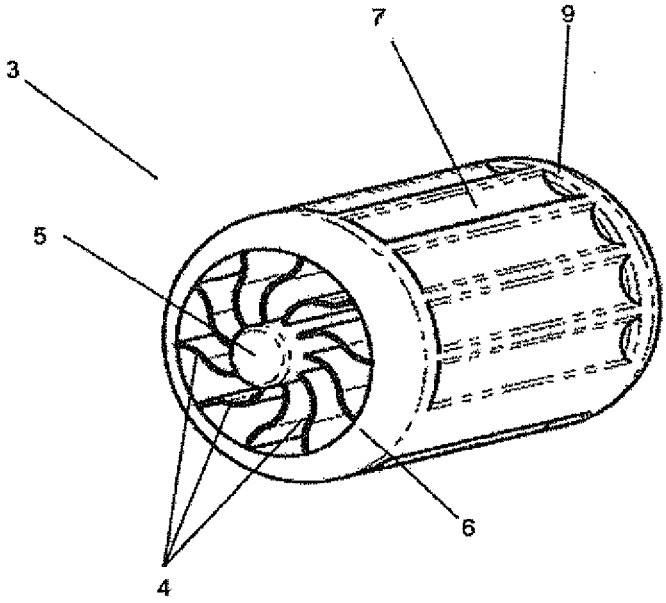
FIG. 2 shows a perspective view of a roll.

FIG. 2 shows a perspective view of an inventive roll 3. The roll 3 is molded in one piece and comprises a shaft 5 having a plurality of spring lamellae 4 extending radially outward from it in the direction of outer sleeve 6 of the roll 3 and thus joining the shaft 5 and the outer sleeve 6 to one another resiliently. Between each spring lamellae 4 is void space as shown in FIG. 2. In this way, the shafts 5 with their journals 28 are resiliently mounted in the roll 3 and/or ball. Therefore, a pressure of the outer sleeve 6 against the inside contour of the holder 1 and against its lips 25 can be achieved.

The spring lamellae 4 have a thin-walled wavy profile and extend essentially over the entire width of the roll. The shaft 3 protrudes beyond the outer sleeve 7 on both ends, so that the shaft 5 can be snapped into the bearing 11 of the container 2.

The outer lateral surface 9 of the roll 3 has a plurality of recesses 7, which are shaped as axial grooves.

Figure 3:
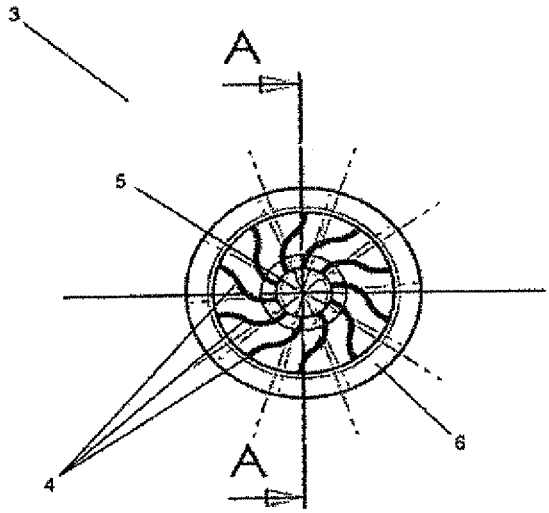
FIG. 3 shows a longitudinal section through a roll.
Figure 4:
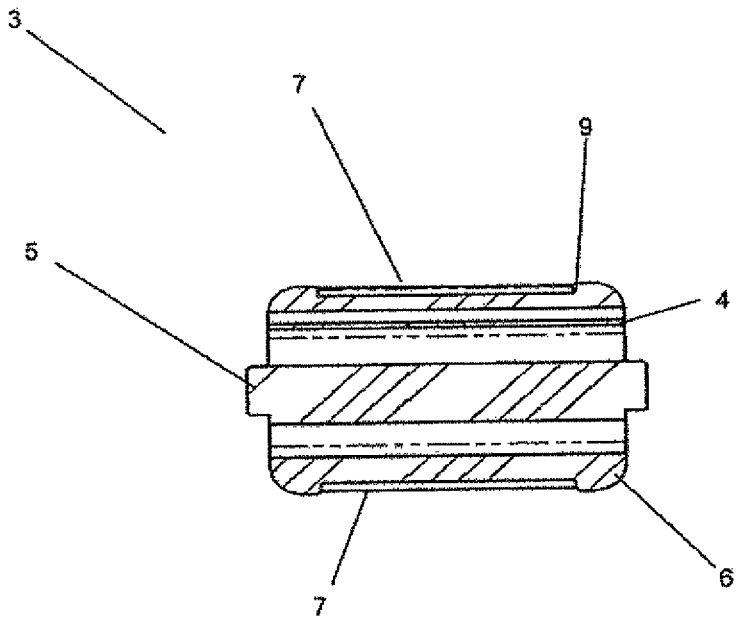

In FIG. 3, the roll 3 known from FIG. 2 is illustrated in a side view. FIG. 4 shows the roll 3 known from FIG. 3 in a longitudinal section.

Figure 5:
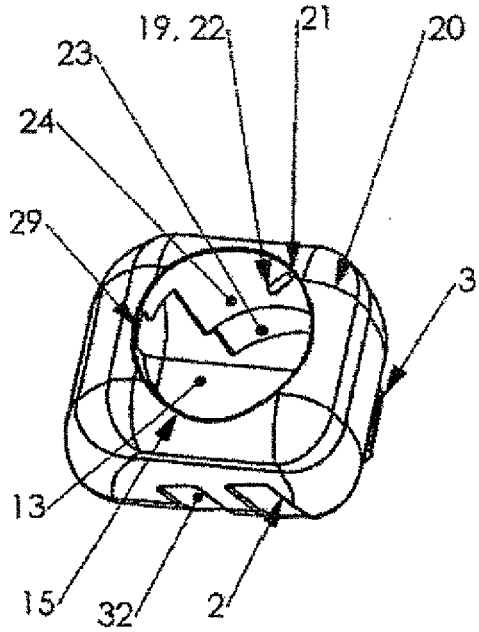
FIG. 5 shows a perspective view into a container having a roll.

FIG. 5 shows perspectively a view into filling opening 15 in the cover 20. An upper sleeve segment 24, which has been snapped into a lower sleeve segment 23 of the container 2 is connected to the filling opening 15. Through this snap-in technique, the user can loosen the cover 20 from the container 2 for the purpose of cleaning. Through a narrow pouring groove 29 in this upper sleeve segment 24, a defined amount of liquid can be poured out with the dosing device. In the normal case, this dosing device is also placed in the washing machine.

Figure 6:
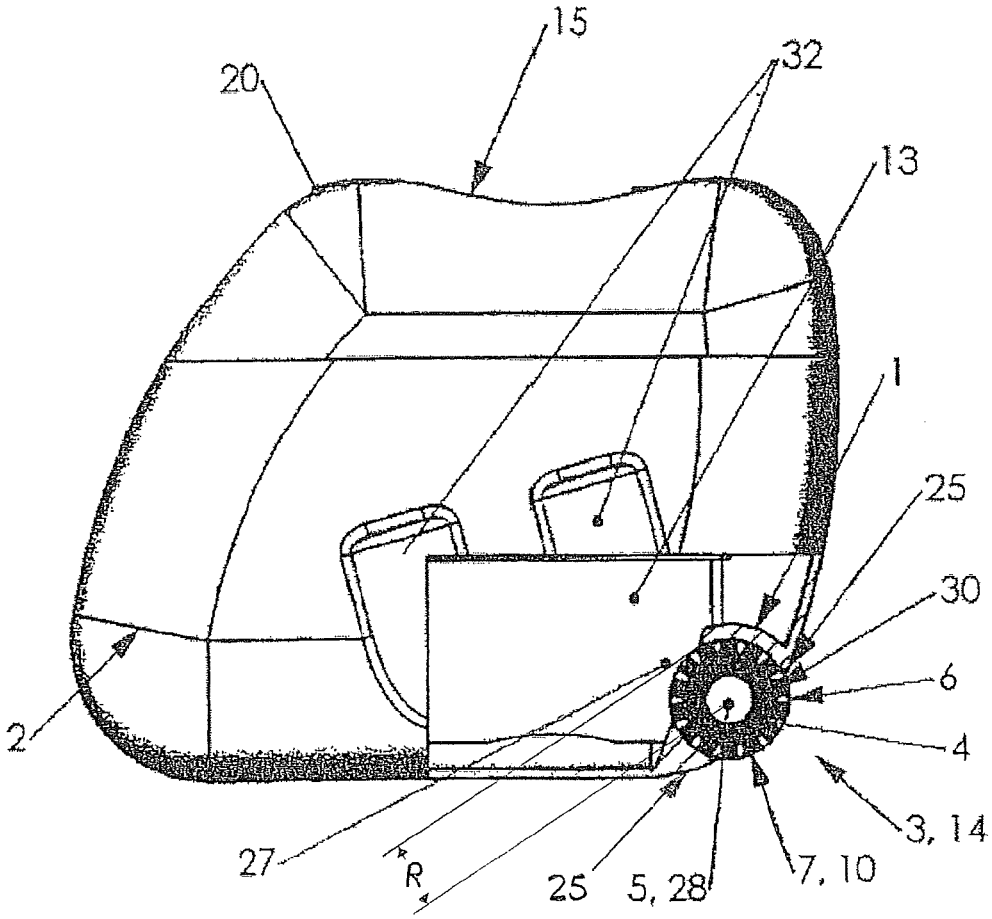
FIG. 6 shows a side view with a partial section of a container having a roll.
Figures 7, 8, 9, 10, 11, 12:
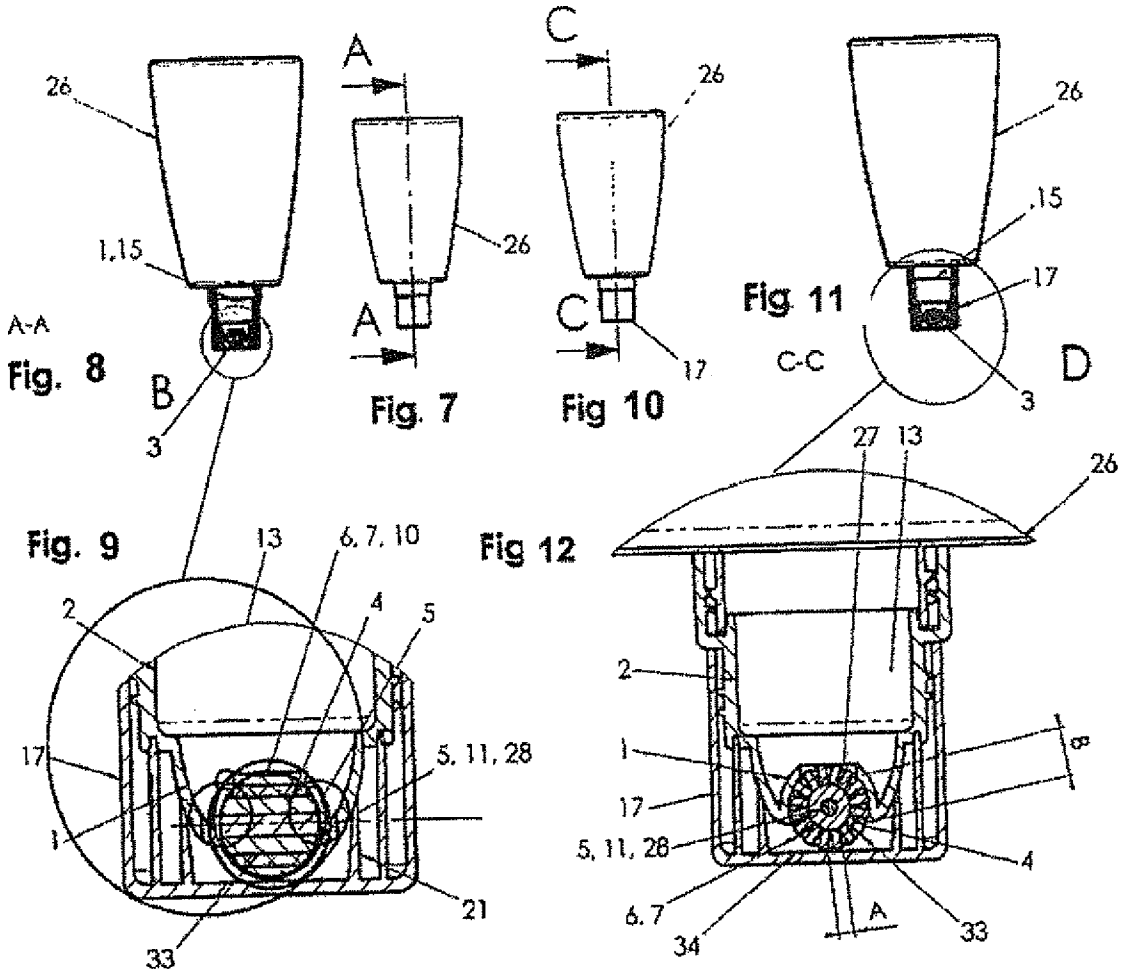
FIGS. 7 through 12 show views and details of a screw cap having a ball.

FIG. 6 shows a side view and a partial section of a complete dosing device having a roll 3. The complete roll 3 runs in a tight fit in the container 2, which is adapted to the radius R of the outer sleeve 6, in the holder 1. Its journals 28 of the shaft 5 made of PA are each snapped into a bearing 11 of the container 2 made of PP. The connection from the interior space 13 to the roll 3 is established via the inner opening 27 in the holder 1. The width of the lips 25 is somewhat less than the outside diameter of the outer sleeve 6. Two recessed grips 32 serve as a support for the index finger and the middle finger.

FIGS. 7 to 12 show a container 2, which is screwed directly onto the bottle 26 containing liquid detergent. A ball 33 having a shaft 5 and a journal 28 moves in this holder 1. For permanent sealing of the container 2 with its ball 33, a screw cap 17 is used here, sealingly pressing with its bottom 35 the ball 33 into the holder 1.

Figure 13:
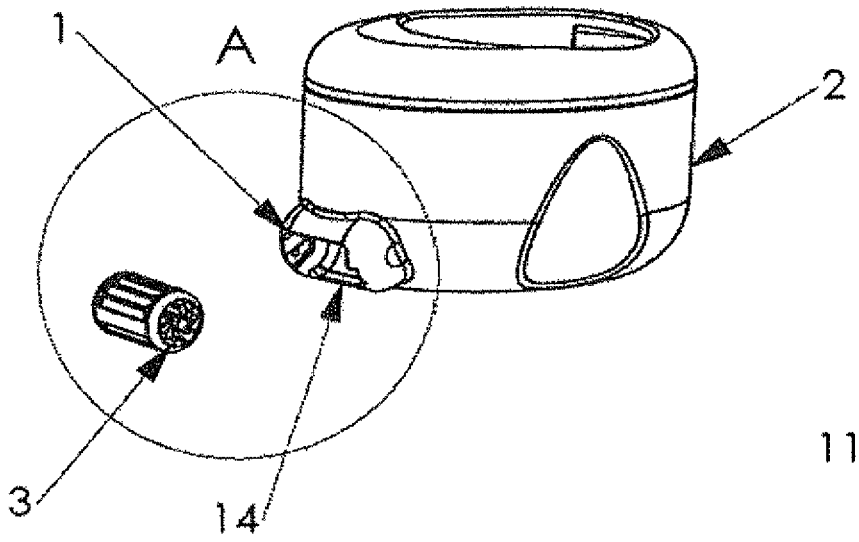
FIG. 13 shows a perspective exploded view of a container having a roll.
Figure 14:
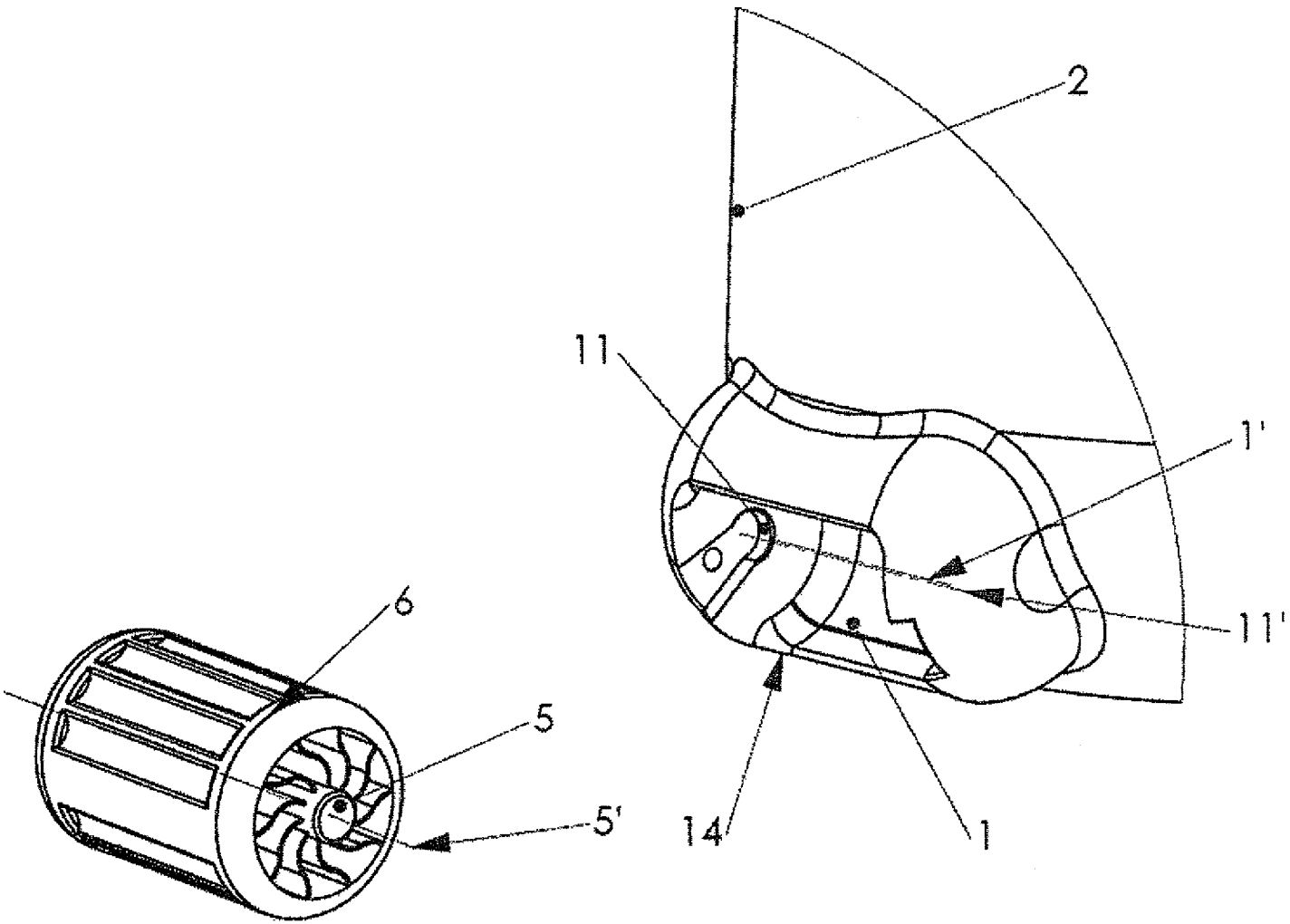
FIG. 14 shows a perspective detailed view of the roll receptacle in the container.

FIG. 13 shows a perspective exploded view of the inventive container having a roll. On the outer opening 14 of the container 2, a holder 1 is formed, designed to receive and support the roll 3. As shown in FIG. 14, the holder 1 has a bearing 11 to receive the shaft 5 of the roll 3. The receptacle of the shaft 5 in the bearing is preferably embodied as a snap-in connection.

The axis 11' of the bearing 11 is shifted easily in the direction of the outer opening 14 with respect to the midpoint 1' of the holder 1.

While preferred embodiments of the invention have been described and illustrated here, various changes, substitutions and modifications to the described embodiments will become apparent to those of ordinary skill in the art without thereby departing from the scope and spirit of the invention.

LIST OF REFERENCE NUMERALS

1 holder
2 container
3 roll
4 spring lamellae
5 shaft
6 outer sleeve
7 recesses
9 lateral surface

10 axial grooves
11 bearing
12 bridge
13 interior space
14 outer opening
15 filling opening
16 collar
17 screw cap
18 bottle
19 tongue
20 cover
21 constriction
22 tamper-proof safety device
23 lower sleeve segment
24 upper sleeve segment
25 lips
26 bottle
27 inner opening
28 journal
29 pouring groove
30 elevations, webs
31 marking
32 recessed grip
33 ball
34 lateral surface
35 bottom
A distance
B arc length
R radius of outer sleeve
r radius of bearing

The invention claimed is:

1. A dosing device having a monolithic roll for dosing liquid detergents, softeners, cleaners, adhesives, paints or other liquids, comprising:

a roll (3) inserted into a holder (1) of a dosing container (2), said roll (3) designed in one piece and having a shaft (5) and an outer sleeve (6) spaced radially apart from the shaft (5) with void space therebetween, said outer sleeve (6) made of plastic and having recesses (7) therein, a plurality of spring lamellae (4) running radially between the shaft (5) and the outer sleeve (6), each of the spring lamellae having a thin-walled wavy profile with at least two bends to develop a spring action between the shaft (5) and the outer sleeve (6) in the radial direction, the shaft (5) is rotatably arranged in one journaled bearing (11) each, and the outer sleeve (6) is pressed sealingly from the inside against lips (25) of the holder (1) by the spring pressure of the spring lamellae (4).

2. The dosing device having a monolithic roll according to claim 1, wherein the spring lamellae (4) have a thickness of less than 1 mm.

3. The dosing device having a monolithic roll according to claim 1, wherein an inner opening (27) in the holder (1) has a width (b) which is smaller than the width (B) of the outer sleeve (6).

4. The dosing device having a monolithic roll according to claim 1, wherein the radius (R) of the outer sleeve (6) is selected to be slightly larger than an inside radius of the bearing (11) up to the lips (25).

5. The dosing device having a monolithic roll according to claim 1, wherein the shaft (5) of the roll (3) is made of a polyolefin having a lubricant additive that migrates to the surface.

6. The dosing device having a monolithic roll according to claim 1, wherein the bearing (11) in the holder (1) has an arc length (B) that is greater than the distance (A) from one recess (7) to neighboring recess (7'), and the holder (1) respectively, and the bearing (11) has an inner opening (27) toward an interior space (13).

7. The dosing device having a monolithic roll according to claim 1, wherein a collar (16) pointing inward is shaped in an edge of a filling opening (15) and is pierced at one location by a pouring groove (29).

8. The dosing device having a monolithic roll according to claim 1, wherein at least one tongue (19) having a constriction (21) as a tamper-proof safety device (22) is integrally molded in a filling opening (15) of the container (2).

9. The dosing device having a monolithic roll according to claim 1, wherein one intermeshing sleeve segment (23, 24) each is shaped in a cover (20) and in the container (2).

10. The dosing device having a monolithic roll according to claim 1, wherein a sleeve segment (23, 24) is formed one each in a cover (20) and in the container (2) to snap into one another.

11. A device for dosing liquids onto a textile or fabric surface by rolling action, comprising:

a holder of a dosing container, said holder defining an opening of a predetermined width with lips at the periphery of the opening;

a monolithic one piece cylindrical roll made of resilient material and having first and second end faces and having a shaft and an outer sleeve spaced radially apart from the shaft, said sleeve having spaced-apart elongated recesses extending in an axial direction in its outer surface which do not protrude all the way to the end faces, said width of said outer surface being longer than the predetermined width of the opening of the holder, wherein said shaft is rotatably arranged within the holder by journaled bearings, and a plurality of spring lamellae being part of the roll made of the resilient material and running radially between the shaft and the outer sleeve joining the shaft and the outer sleeve to one another resiliently, the spring lamellae having a thin-walled wavy profile with at least two bends and with void space between the spring lamellae to develop a spring action between the shaft and the outer sleeve in the radial direction, wherein said outer sleeve is pressed sealingly against the lips of the holder by the spring pressure of the spring lamellae.

12. A device for dosing liquids onto a textile or fabric surface by rolling action, comprising:

a holder of a dosing container, said holder defining an opening with lips at the periphery of the opening;

a monolithic one piece roll made of resilient material and having first and second end faces and having a shaft and an outer sleeve spaced radially apart from the shaft, said sleeve having spaced-apart elongated recesses extending in an axial direction in its outer surface which do not protrude all the way to the end faces, wherein said shaft is rotatably arranged within the holder by journaled bearings, with the shaft positioned within the holder at a distance from the opening such that a greater portion of the outer surface of the sleeve is held within the holder than a remaining portion of the outer surface of the sleeve that is outside of the holder, and a plurality of spring lamellae being part of the roll made of the resilient material and running radially between the shaft and the outer sleeve joining the shaft and the outer sleeve to one another resiliently, the spring lamellae having a thin-walled wavy profile with at least two bends and with void space between the spring lamellae to develop a spring action between the shaft and the outer sleeve in the radial direction, wherein said outer sleeve is pressed sealingly against the lips of the holder by the spring pressure of the spring lamellae.

* * * * *